US008453370B2

(12) United States Patent
Evans-Hendrick

(10) Patent No.: US 8,453,370 B2
(45) Date of Patent: Jun. 4, 2013

(54) SHROUD FOR A FIREARM AND A METHOD OF CONFIGURING THE SAME

(75) Inventor: Andrew James Evans-Hendrick, Suffolk (GB)

(73) Assignee: Riflecraft Limited, Norfolk (GB)

( * ) Notice: Subject to any disclaimer, the term of this patent is extended or adjusted under 35 U.S.C. 154(b) by 157 days.

(21) Appl. No.: 13/011,276

(22) Filed: Jan. 21, 2011

(65) Prior Publication Data

US 2012/0117847 A1 May 17, 2012

(30) Foreign Application Priority Data

May 18, 2010 (GB) ..... 1008218

(51) Int. Cl.
*F41G 1/35* (2006.01)

(52) U.S. Cl.
USPC ..... 42/146; 42/115

(58) Field of Classification Search
USPC ..... 42/105, 114, 115, 117, 146
See application file for complete search history.

(56) References Cited

U.S. PATENT DOCUMENTS

| | | | | |
|---|---|---|---|---|
| 3,755,948 | A * | 9/1973 | Heinicke | 42/17 |
| 5,704,155 | A * | 1/1998 | Primeau, IV | 42/114 |
| 6,655,069 | B2 * | 12/2003 | Kim | 42/114 |
| 7,748,306 | B1 * | 7/2010 | Curry et al. | 89/14.3 |
| 2008/0092422 | A1 * | 4/2008 | Daniel et al. | 42/90 |
| 2010/0154280 | A1 | 6/2010 | LaFrance et al. | |

OTHER PUBLICATIONS

UK Search Report dated Sep. 15, 2010.

* cited by examiner

*Primary Examiner* — Stephen M Johnson
(74) *Attorney, Agent, or Firm* — Andrus, Sceales, Starke & Sawall, LLP

(57) ABSTRACT

A shroud is provided for a firearm having a longitudinal barrel. The shroud is configured to co-operate with formations provided on the firearm barrel such as to provide axial alignment therebetween. The shroud further comprises means for mounting one or more devices to the shroud. The alignment between the barrel and the shroud provides for alignment between the device(s) and the barrel. A firearm comprising such a shroud, and a method of configuring a firearm comprising the shroud are also provided.

12 Claims, 6 Drawing Sheets

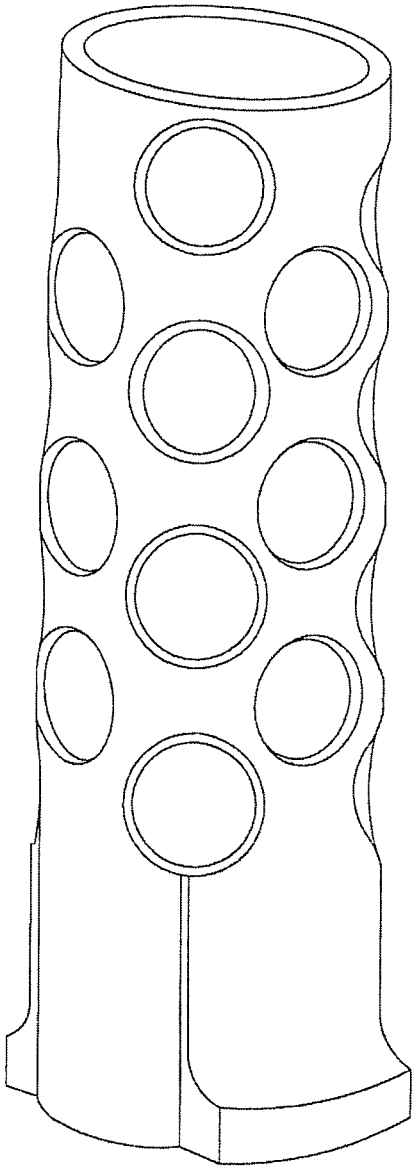
Fig. 0 – PRIOR ART

SHROUD FOR A FIREARM AND A METHOD OF CONFIGURING THE SAME

CROSS-REFERENCE TO RELATED APPLICATIONS

This application claims priority of GB Patent Application 1008218.8, filed May 18, 2010, which is incorporated by reference.

BACKGROUND

The present invention relates to a shroud for a firearm and, in particularly but not exclusively, to a shroud for an M2 machine gun.

The Browning M2 machine gun is a heavy machine gun that can be supported by a tripod or on a vessel or a vehicle. The M2 machine gun is now over 100 years old although the current design and its adaptability to current and evolving technologies has not changed. With the increase of hostilities globally the utilisation of the M2 machine gun has increased dramatically but the ability of modern armies to maintain an operational advantage in a low light/night environment is very difficult when deploying M2 machine guns.

Since the gun recoils heavily when fired, the M2 is provided with a shroud to manage axial movement of the barrel during recoil. A known shroud is shown in FIG. 0. It is also known to utilise the shroud for mounting devices thereto for supporting an accessory such as a torch or thermal device. US 2006/0288626 describes one way in which accessories may be attached to the shroud of an M2 machine gun. Here, a separate adapter is attached to and around an M2 machine gun shroud, the adapter being secured thereto with plugs that pass through lightening perforations provided in the shroud. Disadvantageously, the shroud of FIG. 0 is a poorly quality controlled cast part that cannot accurately be aligned with the barrel of the gun. As a result, the ability of the adapter when attached thereto to accurately align any equipment mounted thereto with the barrel of the gun is time consuming, difficult to conduct without tools and yields marginal results.

There is, therefore, a need to improve alignment between the shroud and any equipment mounted thereon with the machine gun barrel.

The present invention has been designed with the foregoing in mind.

SUMMARY

In accordance with a first aspect of the present invention there is provided a shroud for a firearm having a longitudinal barrel. The shroud may be configured to co-operate with formations provided on the firearm barrel such as to provide axial alignment therebetween. The shroud may further comprise means for mounting one or more devices thereto. The alignment between the barrel and the shroud provides alignment between the device(s) and the barrel.

In accordance with a second aspect of the present invention there is provided a firearm comprising a longitudinal barrel and a shroud mounted thereon.

In accordance with a third aspect of the present invention there is provided a method of configuring a firearm having a longitudinal barrel. The shroud may be attached to the barrel by engaging complementary formations provided on each of the barrel and shroud so as to provide alignment therebetween. Means may be provided for mounting one or more devices to the shroud. The alignment between the barrel and the shroud advantageously provides for alignment between the device(s) and the barrel.

Advantageously, the present invention, as defined in each of the above aspects and embodiments, comprises a new retrofit shroud for a firearm such as an M2 machine gun. The invention enables a rapid transition between technologies mounted to the shroud whilst ensuring any devices attached thereto are precisely aligned with the barrel of the gun.

A further advantage of the invention, in contrast to the device of US 2006/0288626, is that the replacement shroud is permanently attached to the gun and is thus always permanently axially collimated to the bore. Furthermore, the invention replaces the current M2 barrel shroud and threads into the front of the gun receiver in a similar manner, providing for ease and familiarity of use.

Functionally, the invention performs the same task as a known barrel shroud in managing axial movement of the barrel during recoil whilst providing revolutionary mounting options for current and evolving technologies (including but not limited to torches, IR lights, visible and IR lasers and night vision/thermal devices). The dimensions are also such that the invention does not impede the ability of the user to utilise armour shields currently utilised with M2 machine guns.

In an embodiment, the means for mounting one or more devices to the shroud is integrally formed with or directly attached to the body of the shroud. There is, advantageously, no need to provide a separate adapter for the mounting of accessories to the gun, or the need for complex tooling to adapt the gun/shroud to accept accessories.

Preferably, one or more mounting rails are detachably attached to the mounting means of the shroud. The mounting rail(s) may be attachable to and detachable from the shroud by way of one or more fasteners. Preferably, the fastener(s) is(are) screws. Each mounting means advantageously encompasses a "footprint" that can accommodate mounting rails for any current or future light, laser, night vision or thermal technology. Advantageously, only a single, simple tool (e.g. an alien key/torx screwdriver) is required to change from one accessory mount to another.

In an embodiment, the shroud is indexed with respect to the gun barrel. Preferably, indexing occurs at two diametrically opposite positions on the gun barrel.

The firearm barrel formations may comprise an external thread and a corresponding thread is provided internally of said shroud.

The shroud is preferably manufactured by computer numerically controlled machinery. This advantageously provides for high precision manufacture, superior to previous cast shrouds, to provide superior tolerances and alignment.

Furthermore, the invention accommodates both the quick change barrel (QCB) and standard models of the M2 machine gun.

BRIEF DESCRIPTION OF THE DRAWINGS

Embodiments of the invention will now be described with reference to the accompanying drawings in which:

FIG. 0 illustrates a conventional, prior art shroud that is replaced by the shroud of the present disclosure;

DETAILED DESCRIPTION

Figure 1:
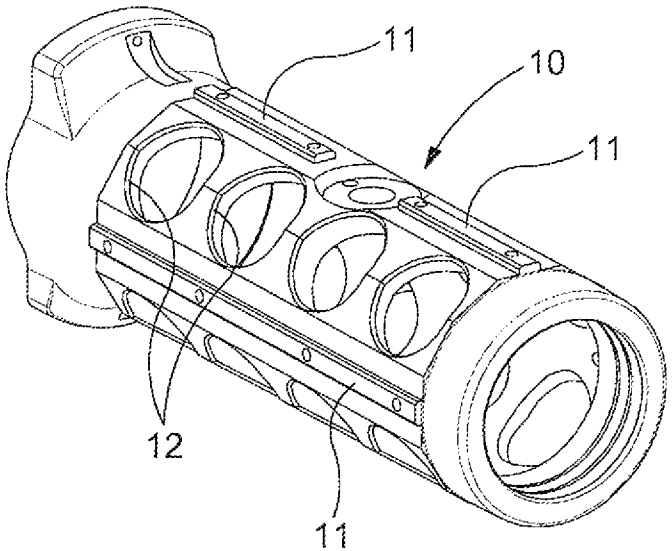
FIG. 1 is a shroud according to an embodiment of the invention.
Figure 2:
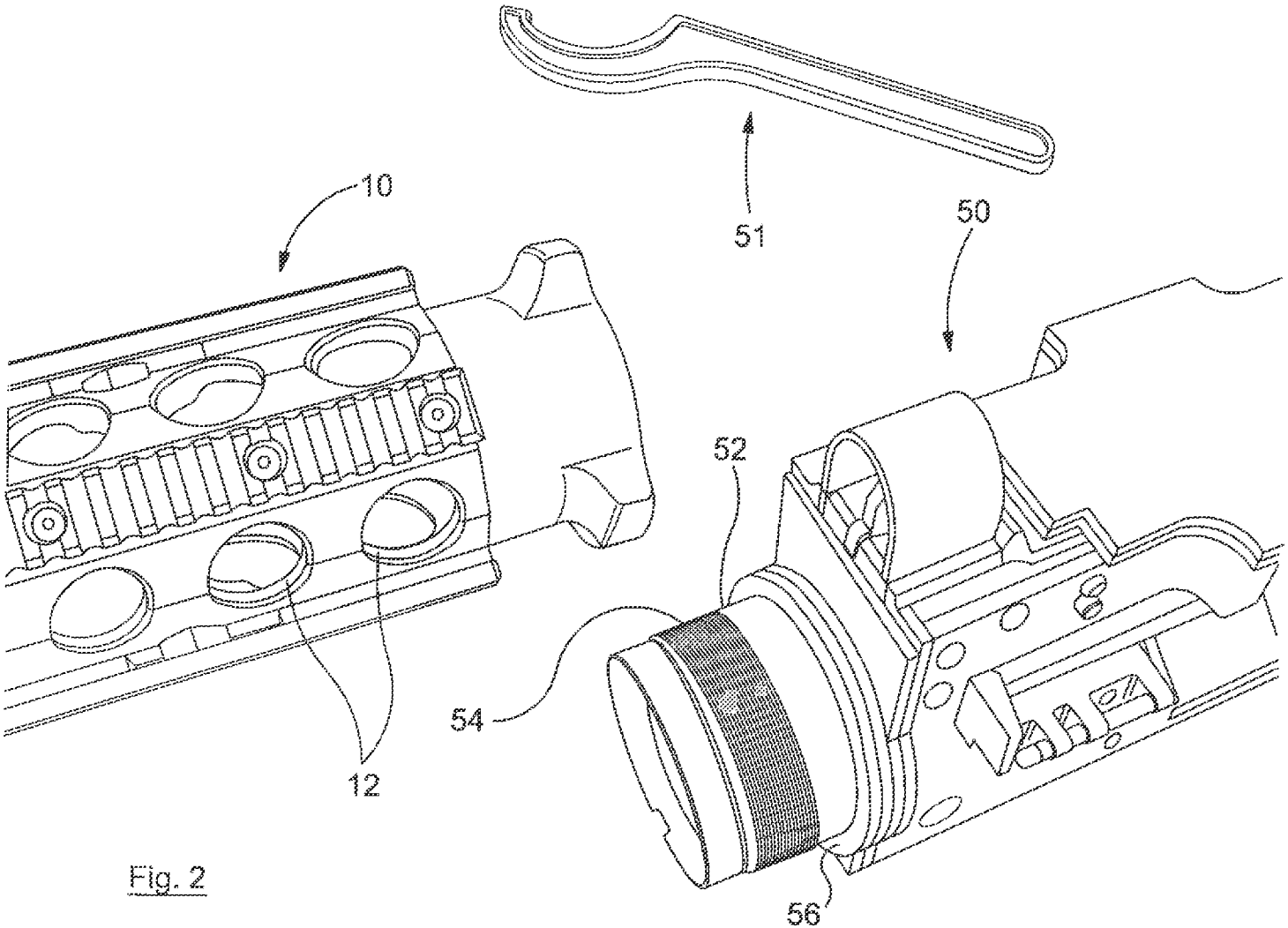
FIG. 2 shows the shroud of FIG. 1, a barrel of a gun and a tool.

FIGS. 1 and 2 show a shroud 10 that is suitable for fitting to a firearm such as an M2 machine gun 50. The shroud 10 is fitted to a barrel 52 of the gun 50 such that the barrel would extend from the right hand side of FIG. 1, with the left hand side of the shroud 10 fitting onto the barrel 52 of the gun 50. Formations e.g. screw threads (not shown) are provided on the interior of the shroud 10 that co-operate with external threads 54 provided on the barrel 52 of the gun 50.

One or more mounting points or platforms 11 are provided on the body of the shroud 10. The mounting platforms 11 are preferably integrally formed with the shroud or are directly affixed thereto.

A conventional tool 51 is used for attaching the shroud 10 to the end of the barrel 52

In an embodiment, the shroud 10 comprises a machined steel replacement (retrofit) barrel shroud 10 for the M2 machine gun. The shroud 10 largely replicates the external dimensions of known M2 barrel shrouds (e.g. as shown in FIG. 0) but is machined to engage with the external threads 54 on the gun barrel to very tight manufacturing tolerances.

The shroud 10 is also machined such as to be indexed from the gun barrel threads 54, e.g. at the 12 and 6 o'clock positions. This is achieved by means of spacers 56, that are placed over the end of the gun barrel around the external thread 54 to limit the extent to which the shroud rotates on the thread. The thickness of the spacers 56 determines the index position of the shroud.

Lightening holes 12 are provided to reduce weight and to facilitate air movement around the reciprocating barrel 52 to aid air cooling. The holes 12 are, advantageously, in exact alignment with each other, unlike those on the previously cast shroud (FIG. 0). In comparison to the known arrangement of US 2006/0288626, the lightening holes are not required for mounting accessories/devices to the shroud, thus maximising their air movement and cooling functionality.

Figure 3:
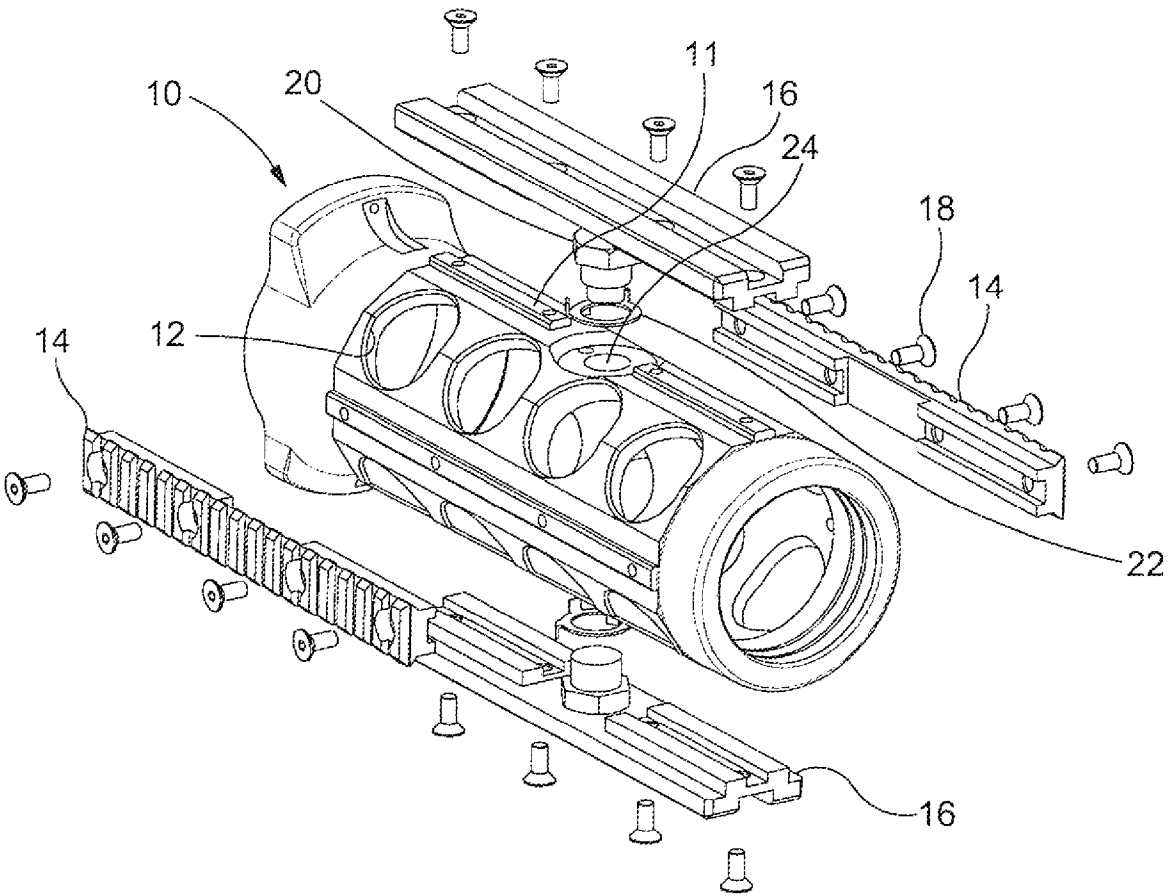
FIG. 3 shows an exploded view of the shroud of FIG. 1 together with rail mounting components.
Figure 4:
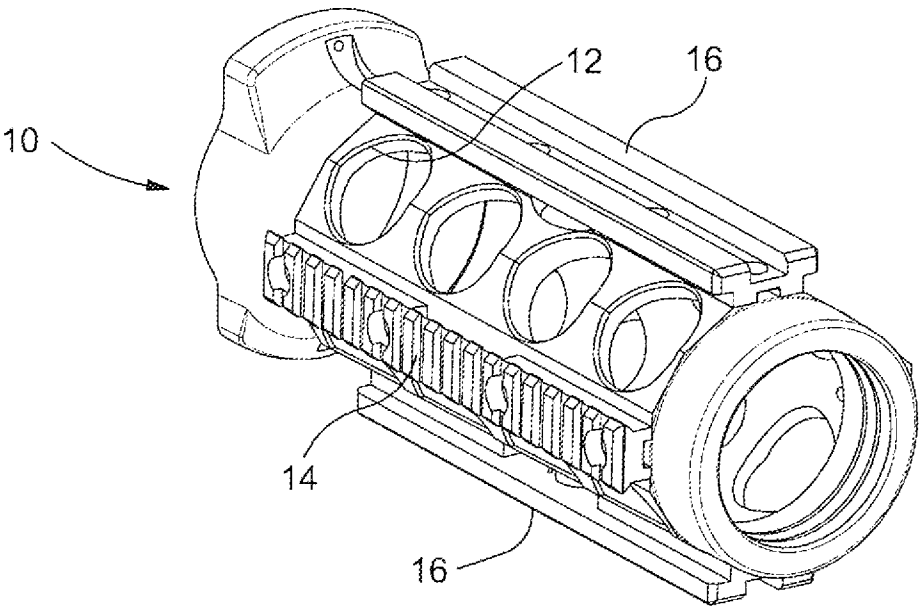
FIG. 4 shows the shroud of FIG. 3 in an assembled state.
Figure 5:
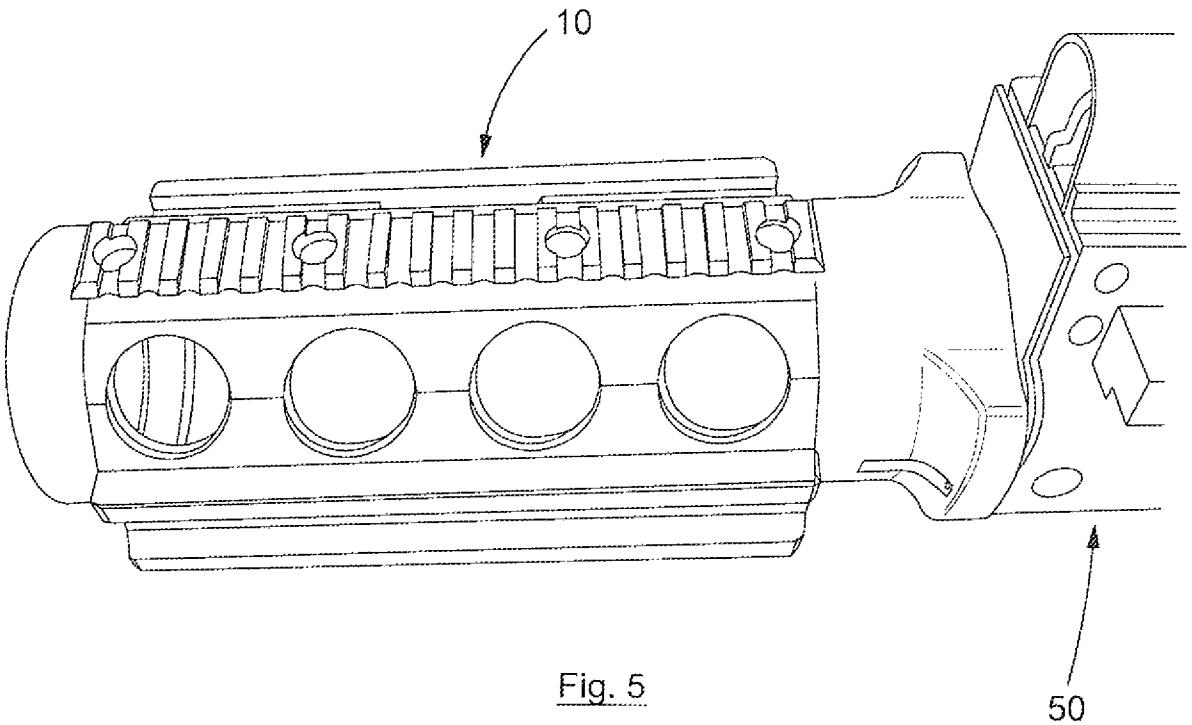
FIG. 5 shows the shroud of FIG. 1 attached to and aligned with the barrel of a gun.

Referring to FIG. 3, attached to the barrel shroud 10 are mounting rails 14, 16. In the embodiment shown, four mounting rails are provided but it will be appreciated that a different number (e.g. one, two, three, or more) may be provided. The mounting rails 14, 16 are attached to the shroud 10 with fixing screws 18. Different types of rail 14, 16 may be provided to accommodate different accessories. In the example of FIG. 2, the rails 14 are Picatinny style rails, which are standard mounting platforms utilized in firearms comprising a series of ridges and slots. Accessories are mounted to the rails 14 by sliding from one end or by clamping thereto. The rails 16 of FIGS. 3 and 4 are light rails for the attachment of lights or similar objects to the shroud.

In an embodiment, a removable stud 20 and washer 22 are also provided to facilitate use with the Quick Change Barrel (QCB) models of the M2 machine gun fitted in an aperture 24 of the shroud 10. Without the stud 20 and washer 22 in place the shroud can be used with older non QCB weapons.

Preferably, the shroud is manufactured using computer numerically controlled (CNC) machining, which enables manufacture thereof to a greater precision and tolerance. The invention thus provides for precise alignment between the shroud and the barrel of the gun, which was not previously possible due to the shroud being cast and thus suffering from poor manufacturing tolerances. Earlier attempts to address this problem involved providing an additional, separate adjustable mounting device (e.g. as described in US 2006/0288626), however such systems still fundamentally incorporate a poorly manufactured and misaligned shroud.

Due to the precise alignment between the receiver, shroud and barrel of the gun in embodiments of the invention, when fitted the mounting platforms 11 are all parallel with the gun barrel 52 as are any rails 14, 16 fitted to such platforms.

The invention is intended to be permanently fitted to any M2 machine gun. Once in place it offers the user the ability to put dedicated mounting rails 14, 16 on to the new barrel shroud 10 and therefore have any technologies mounted upon those rails 14, 16 collimated with the barrel 52 of the gun 50. The importance of this is that, operationally, any user can rapidly transition between lights, lasers and other technologies and maintain the weapon's zero. It also allows multiple mounting of different technologies to account for unknown operational requirements and flexibility.

Advantageously, the dimensions of the shroud 10—being essentially the same as or similar to existing shrouds—permit the use of armour shields in the normal manner.

The invention claimed is:

1. A shroud for a firearm having a longitudinal barrel, the shroud having a thread provided on the interior of one end thereof to co-operate with an external screw thread provided on the firearm barrel such as to provide axial alignment therebetween, the shroud further comprising one or more mounting platforms for mounting one or more devices to the shroud, the axial alignment between the firearm barrel and the shroud providing for alignment between said device(s) and said firearm barrel; and a plurality of spacers for placement on an end of the firearm barrel around the external screw thread, between the shroud and said firearm barrel, to limit the extent to which the shroud rotates on the external screw thread, thereby indexing said shroud with respect to the firearm barrel.

2. The shroud of claim 1, wherein the mounting platforms for mounting one or more devices to the shroud are integrally formed with or directly attached to a body of the shroud.

3. The shroud of claim 1, further comprising one or more mounting rails detachably attached to the mounting platforms.

4. The shroud of claim 3, wherein said one or more mounting rail is attachable to and detachable from the shroud by way of one or more fasteners.

5. The shroud of claim 4, wherein said one or more fasteners are screws.

6. The shroud of claim 1, wherein the shroud is manufactured by computer numerically controlled machinery.

7. A firearm comprising:

a longitudinal barrel;

a shroud having an interior thread provided on one end thereof to co-operate with an external screw thread provided on the longitudinal barrel to provide axial alignment between the shroud and the longitudinal barrel of the firearm, the shroud further including mounting platforms for mounting one or more devices to the shroud, the axial alignment between the longitudinal barrel of the firearm and the shroud providing for alignment between the devices and the longitudinal barrel of the firearm; and a plurality of spacers for placement on an end of the longitudinal barrel around the external screw thread, between the shroud and the longitudinal barrel, to limit the extent to which the shroud rotates on the external screw thread, thereby indexing the shroud with respect to the longitudinal barrel.

8. The firearm of claim 7 wherein the mounting platforms for mounting one or more devices to the shroud are integrally formed with or directly attached to a body of the shroud.

9. The firearm of claim 7 further comprising one or more mounting rails detachably attached to the mounting platforms.

10. The firearm of claim 9 wherein said one or more mounting rails is attachable to and detachable from the shroud by way of one or more fasteners.

11. The firearm of claim 10 wherein said one or more fasteners are screws.

12. A method of configuring a firearm having a longitudinal barrel, the method comprising the steps of:

attaching a shroud to the longitudinal barrel of the firearm by engaging an interior thread of the shroud with a complementary external screw thread provided the barrel so as to provide alignment therebetween; and providing mounting platforms for mounting one or more devices to the shroud, and providing a plurality of spacers for placement on an end of the gun barrel around the external screw thread between the barrel and the shroud to limit the extent to which the shroud rotates on the external screw thread, thereby indexing said shroud with respect to the firearm barrel.

* * * * *